United States Patent [19]

Finsterwald

[11] 4,067,260

[45] Jan. 10, 1978

[54] RACK AND PINION AND ADHESION DRIVE LOCOMOTIVE

[75] Inventor: Emil Finsterwald, Winterthur, Switzerland

[73] Assignee: Schweizerische Lokomotiv-und Maschinenfabrik, Winterthur, Switzerland

[21] Appl. No.: 644,955

[22] Filed: Dec. 29, 1975

[30] Foreign Application Priority Data

Jan. 14, 1975 Switzerland ..... 410/75

[51] Int. Cl.[2] ..... B61B 13/02; B61C 11/04; B61C 15/08; B61C 15/14

[52] U.S. Cl. ..... 105/29 R; 74/710.5; 74/760; 105/108; 105/130

[58] Field of Search ..... 105/29 R, 108, 30, 127, 105/130; 74/674, 710.5, 711, 760

[56] References Cited

U.S. PATENT DOCUMENTS

| | | | |
|---|---|---|---|
| 1,027,073 | 5/1912 | Sessions et al. | 105/29 R |
| 1,027,074 | 5/1912 | Sessions | 105/29 R |
| 1,027,077 | 5/1912 | Sessions | 105/29 R |
| 1,027,078 | 5/1912 | Sessions | 105/29 R |
| 2,316,223 | 4/1948 | Cheneau | 105/30 |

FOREIGN PATENT DOCUMENTS

| | | | |
|---|---|---|---|
| 215,469 | 6/1961 | Austria | 105/130 |
| 1,177,670 | 9/1964 | Germany | 105/29 R |

*Primary Examiner*—Robert J. Spar
*Assistant Examiner*—Howard Beltran
*Attorney, Agent, or Firm*—Kenyon & Kenyon, Reilly, Carr & Chapin

[57] ABSTRACT

Two sets of independently rotatable gear wheels are interconnected between the differential gear coupled to the motor and the two respective reduction drives coupled to the gear wheel rack and pinion drive and adhesion wheel drive. The sets of gear wheels are connected at different drive positions to the differential gear to permit a reduction in stresses in the gear wheel drive and associated rack. A blocking device which is used to block the drive of the gear wheel when needed also allows the adhesion wheel drive to be driven at a higher rate. A clutch is used to vary the drive between the gear wheel and adhesion wheel drive.

4 Claims, 5 Drawing Figures

RACK AND PINION AND ADHESION DRIVE LOCOMOTIVE

This invention relates to a transmission for a railway vehicle having a gear wheel rack and pinion drive and an adhesion wheel drive.

As is known, motorized railway vehicles have been constructed so as to be capable of gear wheel rack and pinion drive and/or adhesion wheel drive. In such cases, the gear wheel drive has been used with a rack on the trackage to overcome steep incline conditions or slippery conditions caused, for example by ice, on the rails. Vehicles of this type have usually been provided with transmissions which permit a switch-over from one drive to the other or a simultaneous operation of both drives from a drive motor. In one known arrangement, suitable reduction drives are fixedly coupled together by a common countershaft, which is preceded by two drives with different reductions, each of which can be selectively coupled by its own coupling with the drive motor. However, in such cases the gearwheel and the adhesion drive shaft are always driven with a different reduction depending on the type of drive. This, in turn, leads to the imposition of unwarranted stress on the rack and the gear wheel drive during times when rack operation is not required and relatively large stresses when rack operation is required.

Accordingly, it is an object of the invention to reduce the stresses imposed on a gear wheel drive and a rack by a railway vehicle capable of gear wheel drive and adhesion wheel drive.

Briefly, the invention provides a transmission for a railway vehicle having a drive motor, a gear wheel drive and an adhesion wheel drive wherein the transmission includes a differential gear drivingly connected with the motor and two reduction drives, each connected to the adhesion wheel drive and the gear wheel drive, respectively. In addition, the transmission includes a first set of gears in the reduction drive of the adhesion wheel drive connected to a first drive position of the differential gear, and a second set of gears in the reduction drive of the gear wheel drive connected to a second drive position of the differential gear with the gears of one set being independently driven from the gears of the other set.

By use of this transmission, the drive torque of the drive motor is divided up during rack travel in accordance with the conditions between the two reduction drives for the gear wheel drive and the adhesion drive. Thus a part, e.g. half of the pulling force to be transmitted, is applied to the gear-wheel drive, and the remainder (practically independently of the degree of wear of the adhesion wheels) is applied to the simultaneously acting adhesion drive. As a result, all cooperating drive parts are stressed correspondingly less. In addition, there is no need to have two couplings in order to change the reduction or speed as in previously known transmissions.

The transmission also employs a blocking means for blocking the transmission of power from the differential gear to the gear wheel drive. This blocking means may be located at the drive position where the gear wheel drive gears are connected to the differential gear. In this way, a change in the reduction of the drive torque may be achieved during adhesion drive in a simple manner so that a higher travel speed can be obtained with adhesion drive than with rack drive. The blocking of this drive place, with the same motor speed, allows the other drive position of the differential gear associated with the adhesion drive to be driven at a correspondingly greater transmission ratio, e.g. at double the r.p.m. At the same time, during adhesion unnecessary wear of the drive gearwheel drive is avoided. Thus, for example during braking, accumulating kinetic energy is reduced and there is less wear on the wheel bearings. Further, because the travel speed in a gearwheel drive usually determines the design power of the drive motor, the attainable change of transmission ratio allows the use of a smaller size motor than before.

In one form of construction, a brake associated with the gearwheel drive may serve as the blocking device.

In order to obtain two different travel speeds during adhesion drive in a simple manner, an optional transmission change in the differential gear may be dispensed with when the two drive positions of the differential gear can be coupled together in non-rotatable manner over a coupling, such as a clutch, that can be engaged and disengaged. Thus, by coupling the two drive positions during gear wheel drive, the vehicle can be driven even with accidental slippage of the adhesion wheels, e.g. when there is ice on the rails. The coupling can also be used with advantage when travelling into or out of rack sections of a trackage. In order to limit the load during drive-gearwheel operation, the coupling can also cooperate with a means for limiting the torque to be transmitted to the wheels.

These and other objects and advantages of the invention will become more apparent from the following detailed description and appended claims taken in conjunction with the accompanying drawings in which:

Figure 1:
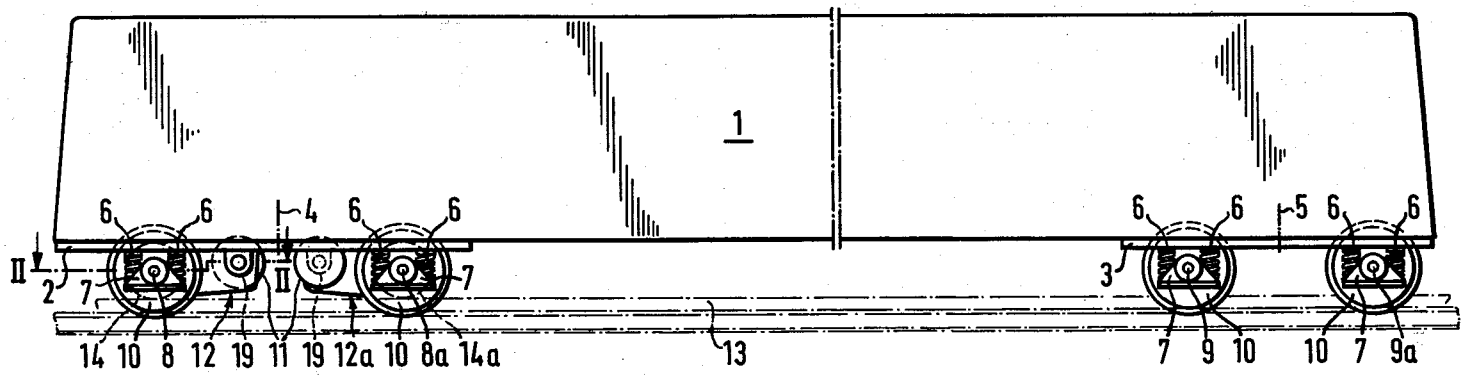
FIG. 1 illustrates a side view of a railway vehicle provided with a transmission according to the invention.

Referring to FIG. 1, the railway vehicle has a vehicle body 1 mounted as is known, e.g. over a pendular suspension, on a drive-bogie 2 and on a traveling bogie 3. Alternatively, a second drive bogie may be used instead of the bogie 3. The bogies 2, 3 each have a frame which is able to turn with the vehicle body 1 about a physical or ideal vertical axis, turning for example about pivots 4, 5. The bogie frames are each supported, over springs 6 and bearings 7, on two drive-shafts **8, 8*a*, or two travel-shafts or axles 9, 9*a* for the vehicle wheels 10**.

Two transverse motors 11 are fastened to the frame of the drive-bogie 2 and each acts by means of a transmission **12, 12*a*, on the corresponding drive shaft 8, 8*a* for the adhesion wheels 10 of an adhesion wheel drive and on a coaxial drive gearwheel 14, 14*a* of a gear wheel drive constructed to engage in a rack 13**.

Figure 2:
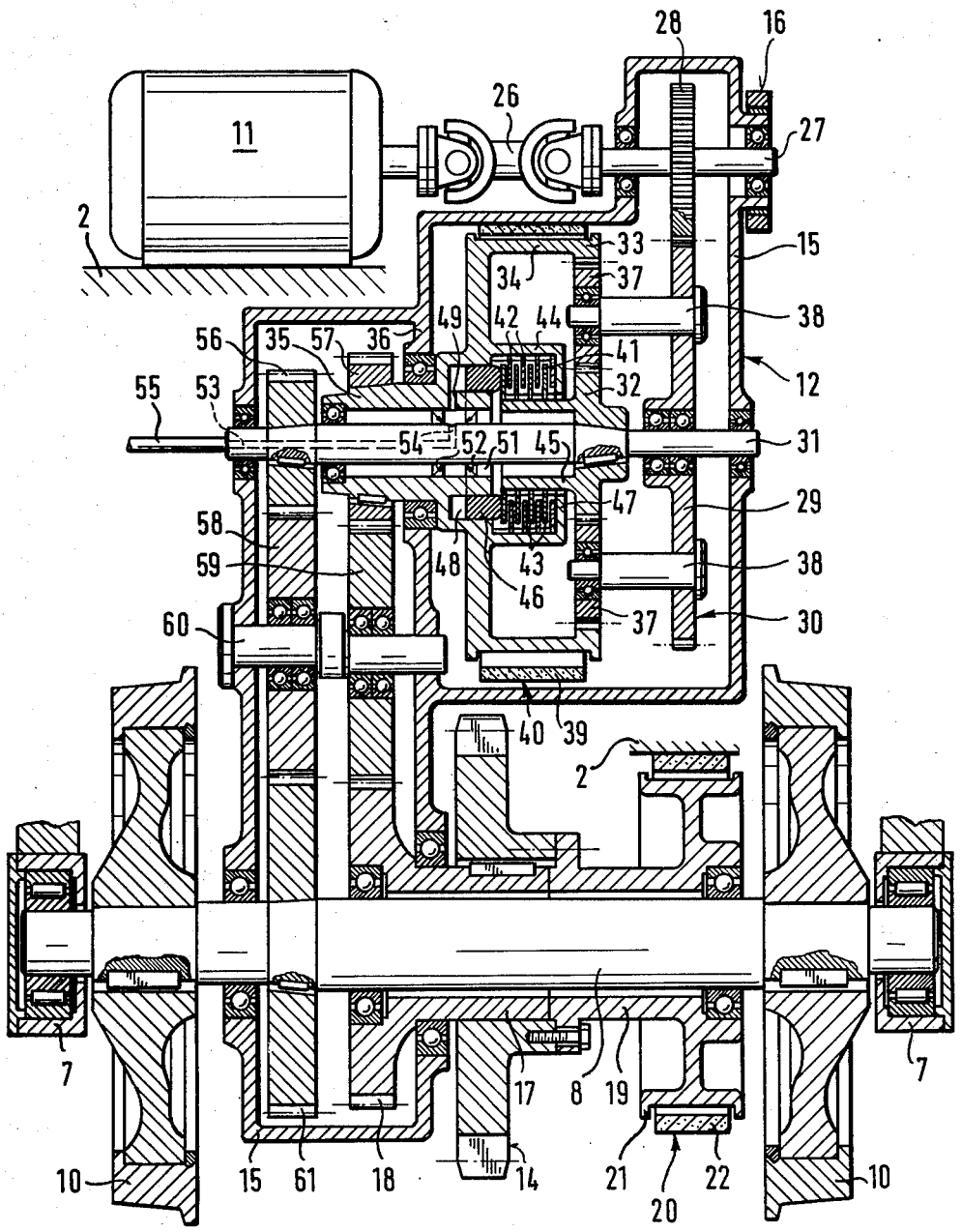
FIG. 2 illustrates to a larger scale a view taken on line II—II of FIG. 1 of a part of the transmission.

FIG. 2 shows only one of the similar transmissions 12 and **12*a*, each of which is housed in a transmission housing 15 which, on the one hand, is movably connected to a torquesupport 16 articulated to the frame of the drive-bogie 2, and, on the other hand, is connected to the corresponding drive-shaft 8, 8*a*, and to a coaxial hollow shaft 17. This hollow shaft 17 is connected in non-rotatable manner to the drive-gearwheel 14, 14*a*, and to a gear 18 mounted rotatably on the drive-shaft 8, 8*a*, as well as to a hollow hub 19 of a brake-drum 21 of a brake 20 mounted the drive-shaft 8, 8***a*. The brake-drum 21 cooperates with a brake-band 22, through levers (not shown). By operating the brake 20, in known manner during rack operation, the gearhweel 14, 14*a*, is braked against undesirable turning in down-grade travel of the vehicle.

The drive-motor 11 is coupled over a cardan-shaft 26 with a shaft 27 which is rotatably mounted in the housing 15 and fastened to a pinion 28. This pinion 28 is in engagement with a gearwheel 29 set on a shaft 31 which is rotatably mounted in the housing 15. The gearwheel 29 forms an input of a differential gear 30. This differential gear 30 has two output drive positions formed by a gear 32 nonrotatably connected to the shaft 31 and a coaxial housing 33 provided with internal teeth. The internal teeth are formed on a cylindrical cover 34 of the housing 33 which surrounds the gearwheel 32 and is rotatably mounted by a hollow hub 35 on the shaft 31. As shown, the hub 35 is rotatably mounted in a partition 36 of the drive-housing 15. The two drive positions are coupled together by four planet-gearwheels 37, of which only two are visible in the drawing. The planet gearwheels 37 mesh with the external teeth of the gearwheel 32 and the internal teeth of the housing 33 and are mounted on pins 38 fastened to the gearwheel 29.

The housing 33 cooperates with a brake-band 39 of a blocking device 40 which band 39 can be pressed against the cover 34. The housing 33 is also coupled in nonrotatable fashion to the gearwheel 32 by a multiple-disk clutch 41. This clutch 41 contains disks 42 and 43 which are disposed in nonrotatable manner and which are axially displaceable in a sleeve 44 connected with the housing 33 or in a hollow-shaft extension 45 of the gearwheel 32. The disks 42, 43 may be pressed together in known fashion by a pressure-ring 46, and against a drivering 47 of the sleeve 44 until the two drive positions of the differential gear 30 are coupled together in fixed manner. The pressure-ring 46 is mounted to be axially displaceable in an annular groove 48 of the housing 33 which is in communication, over radial holes 49, with an annular gap 51 formed between the shaft 31 and the hub 35 and delimited laterally by two seal-rings 52.

The shaft 31 is provided with an axial bore 53 which is in communication with the annular gap 51 through a radial bore 54 and in communication with a selectively operable means (not shown) for supplying a pressure-medium, compressed air in the case of the example shown, via a conduit 55 rotatably connected on the end of the shaft 31.

The shaft 31 and the hub 35 of the housing 33 are each connected with a reduction drive for the respective adhesion wheel drive and gear wheel drive. As shown, the reduction drive for the adhesion wheel drive has a set of gears including a gear pinion 56 in engagement with a gearwheel 58 while the reduction drive for the gear wheel drive has a set of gears including a gear pinion 57 in engagement with a gearwheel 59. The gearhweels 58, 59 are rotatably mounted on an offset shaft 60 which is fastened in the partition 36 and an outer wall of the housing 15. Each of the gearwheels 58, 59 meshes with a gearhweel 61 fastened to drive-shaft 8, or with the gearwheel 18 rotatably mounted on the drive-shaft 8.

In normal gearwheel operation, i.e. over the rack 13 the coupling 41 and the blocking device 40 as well as the brake 20 are disengaged as shown in FIG. 2. During this operation, the drive-torque of the motor 11 is distributed by the differential gear 30 over the two reduction drives 56, 58, 61 and 57, 59, 18, to the drive-shaft 8 or drive-gearwheel 14 respectively, so that both drives act in common. The rack 13 and the drive-gearwheel 14 are thus under a correspondingly smaller load. Because of the transmission ratio existing between the gearwheel 32 and the housing 33, which ratio deviates substantially from 1:1 and the substantially similar transmission ratios in the drivetrains 56, 58, 61 and 57, 59, 18, a correspondingly greater part of the drive-torque is transmitted to the drive-gearwheel 14 than to the drive-shaft 8 and associated adhesion wheels 10 on the rails. The speed of travel is regulated over the motor 11 in known manner and the brake 20 serves as the brake for stopping as well as against uncontrolled down-grade travel.

By operating the compressed-air supply means, the annular groove 48 can be put under pressure, and thus the multi-disk clutch 41 can be engaged, so that the differentialgear 30 becomes locked, and the gearwheel drive and adhesion drive are firmly coupled together. As a result, for example when running into and running out of rack sections, smooth transition is obtained at each change in the method of operation. Furthermore, with the differential gear 30 locked, racing of the track-wheels 10 is prevented, and thus the gearhweel drive is ensured for extreme operating conditions, e.g. iced rails.

Furthermore, when operating under adhesion drive, the transmission 12 offers two switching possiblities. In one case, with the multi-disk clutch 41 engaged, or else left engaged after leaving the rack section, and with the blocking device 40 disengaged, the railway vehicle is driven over the locked differential gear 30 with the same speed as during gearwheel operation. During this time, the drive-train 57, 59, 18 turns idly with the drive-gearwheel 14.

In the second switching position, the multidisk clutch 41 is disengaged, and the blocking device 40 is operated, so that the housing 33, the reduction drive 57, 59, 18 and the gearwheel 14 become blocked independently of the brake 20. Thus, with the motor speed remaining the same, the gearwheel 32 is driven at a higher speed, corresponding to the transmission ratio of the differential gear 30, and the railway vehicle is given a correspondingly higher speed of travel.

Of course the brake 20 and the blocking device 40 may be constructed in some other way, e.g. as shoe-brakes.

In connection with the transmission 12, the motor 11 may be constructed for relatively high speed and correspondingly optimum power output during gearwheel drive, i.e. the motor may be relatively small. Because of the change of transmission which is made possible by the transmission 12 it is possible to obtain a higher travel speed with adhesion operation at the same motor speed simply by a suitable choice of the transmission ratio of the driving connection to give a predetermined travel speed.

Figure 3:
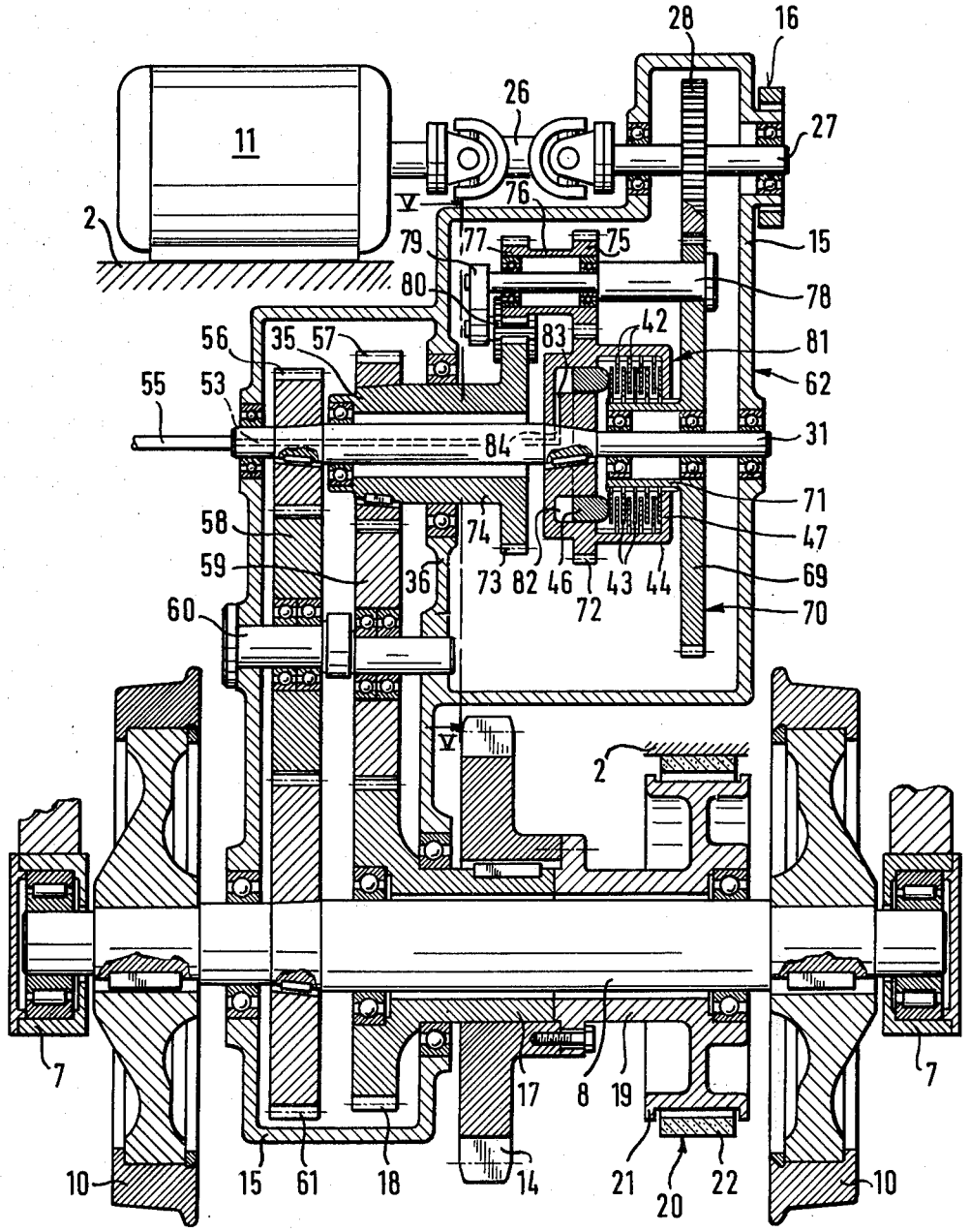
FIGS. 3 and 4 show in each a modified form of construction of the transmission according to the invention in corresponding horizontal sections.

Referring to FIG. 3, wherein corresponding parts are given the same reference numerals, the transmission 62 has a gear-pinion 28 which meshes with a gearwheel 69 of a differential gear 70 which, in turn, connects to two drive-trains or reduction drives 56, 58, 61 and 57, 59, 18. The gearwheel 69 is seated in nonrotatable manner on a hollow shaft 71 which is rotatably mounted on the shaft 31. The two output drive positions of the differential gear 70 are a gearwheel 72 fastened on the shaft 31, and a gearwheel 73 rotatably mounted by a hub 74 on the shaft 31, and in the partition 36 of the drive-housing 15. A gear pinion 57 is fastened to the hub 74.

Figure 5:
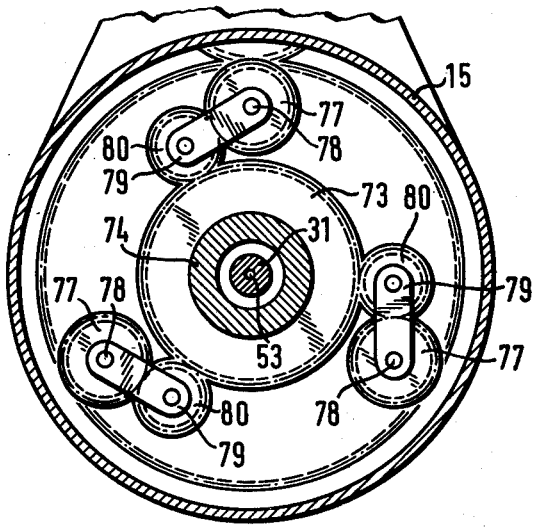
FIG. 5 illustrates a view taken on line V—V of FIG. 3.

The gearwheel 72 meshes with three planetary wheels 75, each of which is nonrotatably connected, over a hollow shaft 76, with a coaxial planetary wheel 77. The three pairs of planetary wheels 75, 77 (FIG. 5) are each mounted on a pivot-pin 78 fastened to the gearwheel 69. The pin 78 carries an axle-holder 79, upon which an intermediate gearwheel 80 is rotatably mounted in mesh with the planetary wheel 77 as well as with the gearwheel 73 (FIG. 5). An engageable and disengageable multi-disk clutch 81 is disposed between the drive-gearwheel 69 and the driven gearwheel 72 and has a sleeve 44 connected with the gearwheel 72. The clutch 81 has disks 42, 43 mounted nonrotatably and axially displaceably in the sleeve 44 and on the hollow shaft 71 respectively. The pressure-ring 46 is displaceable axially in an annular groove provided on the gearwheel 72. As above, a radial bore 83 forms an outlet for the annular groove 82. The bore 83 is in communication with the axial bore 53 in the shaft 31 over a suitable bore 84 in the shaft 31. In addition, the bore 84 is connected to the conduit 55 of the pressure-medium supply means (not shown).

The transmission ratio of the differential gear 70 may in a particularly simple way be adapted to the desired perdetermined ratio of the gearwheel and adhesion drives' part-torque to be transmitted.

The way in which the transmission 62 operates corresponds essentially to that of the transmission 12 of FIG. 2. Differing from that, the drive gearwheel 69 and the driven gearwheel 72 are firmly coupled to lock the differential gear 70. Furthermore, instead of its own blocking device, the brake 20 is provided for the blocking of the unblocked drivegearwheel 73 and of the gear-train 57, 59, 18, as well as the drive-gearwheel 14 at a change of transmission.

Figure 4:
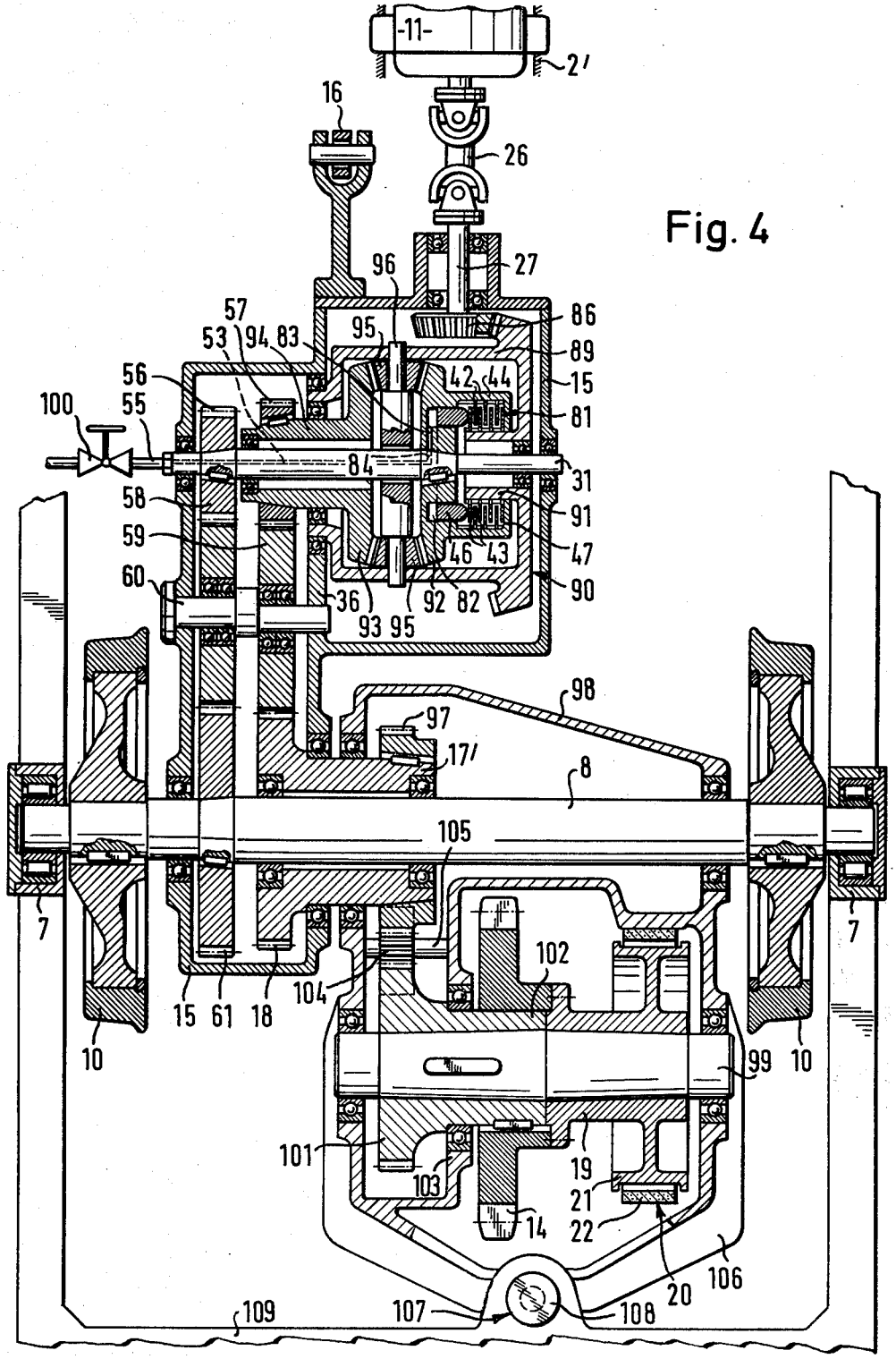

Referring to FIG. 4, wherein like reference characters indicate like parts as above, the motor 11 is set in a drive-bogie 2 whose longitudinal axis is parallel with the motor shaft. The shaft 27 which is suitably coupled thereto in the gear-housing 15, carries a bevel gearwheel 86, which meshes with bevel teeth of a housing 89 of a bevel-wheel differential gear 90, which connects the gear-trains 56, 58, 61 and 57, 59, 18. The differential housing 89 is mounted at one end in the partition 36 of the gear-housing 15, and at the other end on the shaft 31, and is provided with a hollow-shaft appendage 91. A bevel-wheel 92 is fixed on the shaft 31 within the housing 89 while a bevel-gear 93 is rotatably mounted via a hub 94 on the shaft 31 so as to turn in the differential housing 89.

The two bevel-gears (drive positions) 92, 93 are coupled by planetary bevel-wheels 95, of which only two are visible in the drawing. The planetary bevel-wheels 95 are mounted on a common carrier 96, held by at the ends in the differential housing 89.

The pressure-ring 46 of the multiple-disk clutch is mounted on the bevel-wheel 92, with the sleeve 44 for the disks 42 attached. The disks 43 are guided on the hollow-shaft appendage 91 of the housing 89. The gear-pinion 57 of the gear-train 57, 59, 18 associated with the drive-gearwheel 14 is fixed on the hub 94 of the bevel-wheel 93. The pressure-medium supply line 55 is provided with an adjustable pressure-reducing valve 100 which acts as a means to limit torque.

The gearwheel 18 is provided with a hollow shaft 17' which is rotatably mounted on the drive shaft 8 as well as in the housing 15, and is connected nonrotatably outside the housing 15 with a gearwheel 97. A housing 98 is mounted on the hollow shaft 17' and on the drive-shaft 8 so as to be pivotal thereto. The housing 98 houses an axle 99 which is parallel to the drive-shaft 8. The brake-drum 21 of the brake 20 and a gearwheel 101 are disposed on the axle 99. The hub 102 of the gearwheel is rotatably mounted in a partition 103 of the housing 98, and is nonrotatably connected with the drive-gearwheel 14 as well as with the hub 19 of the brake drum 21. The brake-band 20 is fastened to the housing 98. The gearwheel 101 is in engagement with a gearwheel 104, set on an axle 105 mounted in the partition 103 and in the outer wall of the housing 98, and meshes with the gearwheel 97.

The housing 98 is provided with a bow 106, connected for example to a piston-rod of an approximately vertical pneumatic piston/cylinder unit 107, whose cylinder 108 is linked to an unsprung frame 109 of the bogie 2' connected to the bearings 7. The cylinder 108 contains a piston (not shown) which is raised and lowered by means of compressed air in known manner. Thus, the housing 98 is pivoted by means of the piston-rod in corresponding manner, and the drive-gearwheel 14 is brought into and out of engagement with the rack 13 (FIG. 1).

By use of the bevel-gear differential drive 90, the drive-torque is distributed in equal parts to both drive-trains 56, 58, 61 and 57, 59, 18, which have substantially similar transmission ratios. Therefore, with the same size of gear-wheels 97 and 101, the same partial torques are transmitted during gearwheel-drive (with the brake 20 and coupling 81 disengaged) over the drive-gearwheel 14 and simultaneously acting drive-shaft 8.

In order to lock the differential gear 90, compressed air is sent into the annular groove 82. The housing 89 is then firmly coupled to the bevel-wheel 92, and thus to the gearwheel drive and to the adhesion drive through the multiple-disk clutch 81. By suitable adjustment of the valve 100, the transmitted torque is limited.

With adhesion drive, the transmission change is carried out as already described, in that (with the multiple-disk clutch 81 disengaged) the drive bevel-wheel 93, together with the drive-train 57, 59, 18, 97, 101, 104 and the drive-gearwheel 14, are blocked through application of the brake 20.

Because of the approximately equal transmission ratios in both gear-trains, the drive-shaft 8 with the adhesion wheels 10 is driven at double the rpm of the gearwheel drive for the same motor speed.

Various other forms of construction of the invention are possible. Thus, for example, the drive-gearwheel 14 may be mounted independently on a hollow shaft surrounding the drive-shaft 8 with clearance which in known manner (with sufficient clearance between the hollow shaft and drive shaft and with a suitable arrangement of the driving connection) can be adjusted in height, and be raised and lowered to come into and out of engagement with the rack. Of course, a hydraulic drive may be provided to raise and lower the drive-wheel, or else some mechanical device may be used.

Instead of the described pneumatic multidisk clutch and corresponding arrangement to limit the torque, other means of a hydraulic or some other nature used in vehicle building may be made use of, e.g. mechanical coupling with adjustable spring-pressure plates.

What is claimed is:

1. A transmission for a railway vehicle having a drive motor, a gear wheel rack and pinion drive and an adhesion wheel drive, said transmission including a differential gear drivingly connected with said motor, said differential gear having two output drive positions;

a first reduction drive having a first set of gears connected to said adhesion wheel drive and to a first drive position of said differential gear;

a second reduction drive having a second set of gears connected to said gear wheel drive and to a second drive position of said differential gear, said gears of said second set of gears being independently driven from said gears of said first set of gears; and a clutch for selectively coupling said first and said second sets of gears together for simultaneous rotation at said first and said second drive positions.

2. A transmission as set forth in claim 1 which further includes a blocking means for blocking the transmission of power from said differential gear to said gear wheel drive.

3. A transmission as set forth in claim 2 wherein said blocking means is a brake disposed about said gear wheel drive.

4. A transmission as set forth in claim 2 wherein said blocking means is a brake located at said second drive position for braking said gear wheel drive to effect an increase in speed in said adhesion wheel drive.

* * * * *

UNITED STATES PATENT AND TRADEMARK OFFICE

CERTIFICATE OF CORRECTION

PATENT NO. : 4,067,260

DATED : January 10, 1978

INVENTOR(S) : Emil Finsterwald

It is certified that error appears in the above-identified patent and that said Letters Patent are hereby corrected as shown below:

Column 3, line 2, after "mounted" insert --about--

Column 3, line 5, change "gearhweel" to --gearwheel--

Column 3, line 37, change "drivering" to -- drive-ring--

Column 4, line 19 change "differentialgear" to --differential-gear --

Column 5, line 27 change "perdetermined" to --predetermined--

Column 5, line 35 change "drivegearwheel" to --drive-gearwheel--

Column 6, line 31 change "gear-wheels" to --gearwheels--

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*